US006065246A

United States Patent [19]

Detassis

[11] Patent Number: 6,065,246

[45] Date of Patent: May 23, 2000

[54] DEVICE FOR DRIVING THE REVOLVING TRIPOD OF A TWO-WAY TURNSTILE

[75] Inventor: Marco Oreste Detassis, Martignano, Italy

[73] Assignee: Italdis Industria S.p.A., Lavis, Italy

[21] Appl. No.: 09/171,125

[22] PCT Filed: Apr. 10, 1997

[86] PCT No.: PCT/IT97/00078

§ 371 Date: Oct. 13, 1998

§ 102(e) Date: Oct. 13, 1998

[87] PCT Pub. No.: WO97/38203

PCT Pub. Date: Oct. 16, 1997

[30] Foreign Application Priority Data

Apr. 11, 1996 [IT] Italy ..... MI96A0694

[51] Int. Cl.[7] ..... E06B 11/08

[52] U.S. Cl. ..... 49/47

[58] Field of Search ..... 49/42, 46, 47

[56] References Cited

U.S. PATENT DOCUMENTS

| | | | |
|---|---|---|---|
| 2,504,535 | 4/1950 | Kilpatrick | 49/47 |
| 3,397,486 | 8/1968 | Foxwell et al. | 49/47 |
| 3,978,613 | 9/1976 | Hayward et al. . | |
| 5,072,543 | 12/1991 | Tetherton | 49/47 |
| 5,146,711 | 9/1992 | Gallenschütz et al. . | |

FOREIGN PATENT DOCUMENTS

| | | |
|---|---|---|
| 0 331 652 A1 | 9/1989 | European Pat. Off. . |
| 27 58 971 A1 | 7/1978 | Germany . |

*Primary Examiner*—Jerry Redman
*Attorney, Agent, or Firm*—Akin, Gump, Strauss, Hauer & Feld, L.L.P.

[57] ABSTRACT

A device for driving the revolving tripod of a two-way turnstile includes a wheel (1) keyed onto a shaft (2) together with a trilobate cam (3) and the tripod, a positioning mechanism engaging said cam (3) and suitable to cause the rotation thereof upto one of three stop positions 120° apart, and two specular mechanisms for locking said wheel (1) each one including an L-shaped lever (9, 9') rotating around a pin (13, 13') and driven by a rod (10, 10') in turn driven by an electromagnet (11, 11') which overcomes the bias of a spring (12, 12'). The wheel (1) is shaped as an equilateral triangle with convex sides having a particular peripheral profile including a series of teeth and steps with straight flanks and different heights (14, 15*a,* 15*b,* 15*c,* 16), the spring (12, 12') being possibly arranged on the rod (10, 10') so as to keep the lever (9, 9') in contact with or away from the wheel (1) when the electromagnet (11, 11') is not activated.

8 Claims, 3 Drawing Sheets

DEVICE FOR DRIVING THE REVOLVING TRIPOD OF A TWO-WAY TURNSTILE

BACKGROUND OF THE INVENTION

1. Field of the Invention

The present invention relates to tripod turnstiles, and in particular to a device for driving the revolving tripod of a two-way turnstile.

2. Description of the Related Art

It is known that tripod turnstiles are used in various situations for monitoring the flowing of people through passages, e.g. for the access to subway stations. The operating sequence may be that of allowing the tripod to revolve only upon an unlocking command, typically through the obliteration of a ticket, or the opposite one of a freely revolving tripod which is blocked upon command. If the flow control can be performed in both directions of passage, you have a two-way turnstile.

In prior art turnstiles the combination of the bidirectionality with the alternative locking or unlocking sequences leads to quite complicated and sophisticated devices. This implies a high manufacturing cost, as well as a greater risk of failures or malfunctionings.

SUMMARY OF THE INVENTION

Therefore the object of the present invention is to provide a device for driving the revolving tripod of a two-way turnstile which allows the above-mentioned different operating sequences while being structurally simple.

This object is achieved by means of a device having the characteristics disclosed in claim 1.

A first advantage of the present driving device, stemming from its structural simplicity, is the lower manufacturing cost combined with a higher resistance and reliability.

A second advantage of this device is given by its capability in taking up the play and returning to the starting position whenever an unauthorized walking-through is attempted or an authorized walking-through is not completed.

These and other advantages and characteristics of the device according to the present invention will be clear to those skilled in the art from the following detailed description of an embodiment thereof, with reference to the annexed drawings.

BRIEF DESCRIPTION OF THE DRAWINGS

FIG. 2 is a view similar to the preceding one with the device unlocked to allow an authorized walking-through;

DESCRIPTION OF THE PREFERRED EMBODIMENT

Figure 1:
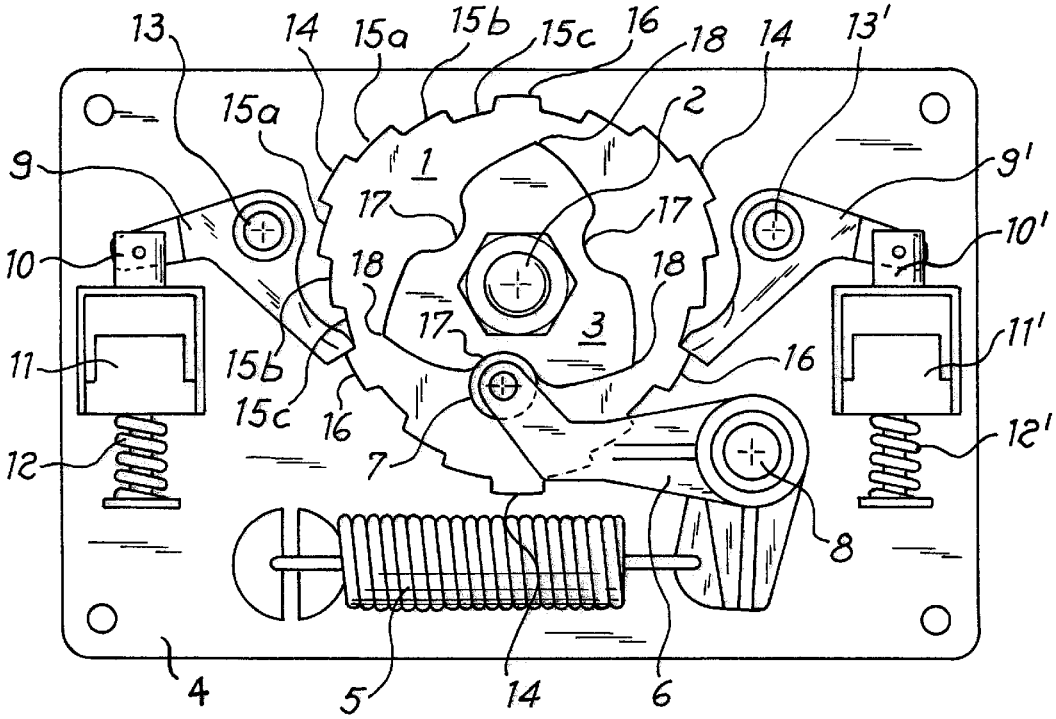
FIG. 1 is a schematic front view of the present device in the locked position according to a first operating sequence.

Referring to FIG. 1, there is seen that the device according to the present invention essentially includes a wheel 1, having a particular profile, keyed onto a central shaft 2 together with a cam 3 and the tripod (not shown), as well as a positioning mechanism engaging cam 3 and two specular mechanisms for locking wheel 1 located at symmetrical positions with respect thereto, said three mechanisms being secured onto a supporting plate 4.

The positioning mechanism includes a return spring 5 and a follower 6, which is substantially L-shaped and carries a roller 7 at the end of the longer arm so as to follow the profile of cam 3. The spring 5 is secured at one end to plate 4 and at the other end to the shorter arm of follower 6, which is fixed onto plate 4 through a pin 8 located at the corner between its two arms.

Each of the two specular mechanisms for locking wheel 1 includes a lever (9, 9') connected at one end to a rod (10, 10') passing through an electromagnet (11, 11'), a biasing spring (12, 12') being arranged on said rod. The electromagnets 11, 11' and the levers 9, 9' are secured onto plate 4, each lever being substantially L-shaped and fixed through a pin (13, 13') located at the corner between its two arms, similarly to follower 6.

The wheel 1 is substantially shaped as an equilateral triangle with convex sides, having a peripheral profile characterized by a series of teeth and steps with straight flanks. These teeth and steps have the same width but different heights, the height being meant as the distance measured radially from the center of wheel 1 to the periphery thereof. More precisely, a tooth 14 having the greatest height is found every 120°, i.e. at the three vertices of the triangle, and is followed in both directions of rotation by three steps (15*a*, 15*b*, 15*c*) of decreasing height. Finally, an intermediate tooth 16 is found every 120° at the middle of each side, i.e. 60° apart from the vertices 14. This tooth 16 is as high as the second step (15*b*) of said three decreasing steps, whereby it projects with respect to the shortest steps (15*c*) adjacent thereto.

Therefore, the profile of wheel 1 globally includes three vertex teeth 14, three intermediate teeth 16 and six groups of three decreasing steps 15*a*, 15*b*, 15*c*. Thanks to the symmetrical arrangement of said teeth, starting from any intermediate teeth 16 and proceeding either clockwise or counter-clockwise you always find three steps of increasing height (15*c*, 15*b*, 15*a*), then a vertex tooth 14 and finally three steps of decreasing height (15*a*, 15*b*, 15*c*) before reaching the following intermediate tooth 16.

The cam 3 is shaped as an equilateral triangle with convex sides having a marked central depression 17 provided with a bending radius substantially equal to the radius of roller 7. The result is a trilobate shape with lobes ending in an apex 18. Cam 3 is keyed onto shaft 2 so that each apex 18 is substantially located at a corresponding intermediate tooth 16, slightly upstream therefrom in the clockwise direction.

In the situation illustrated in FIG. 1 the device according to the present invention is in a locked position, with the free ends of the two levers 9, 9' abutting against the flanks of two intermediate teeth 16 so as to prevent the rotation of wheel 1 either clockwise or counterclockwise. Therefore, also the revolving tripod is locked since it is integral with shaft 2 on which wheel 1 is keyed. The return spring 5 of the positioning mechanism keeps follower 6 pushed against cam 3, and precisely with roller 7 abutting in the depression 17 formed in the side of cam 3 which is facing spring 5.

The operation of the device will now be explained with reference to FIGS. 2 to 5.

Figure 2:
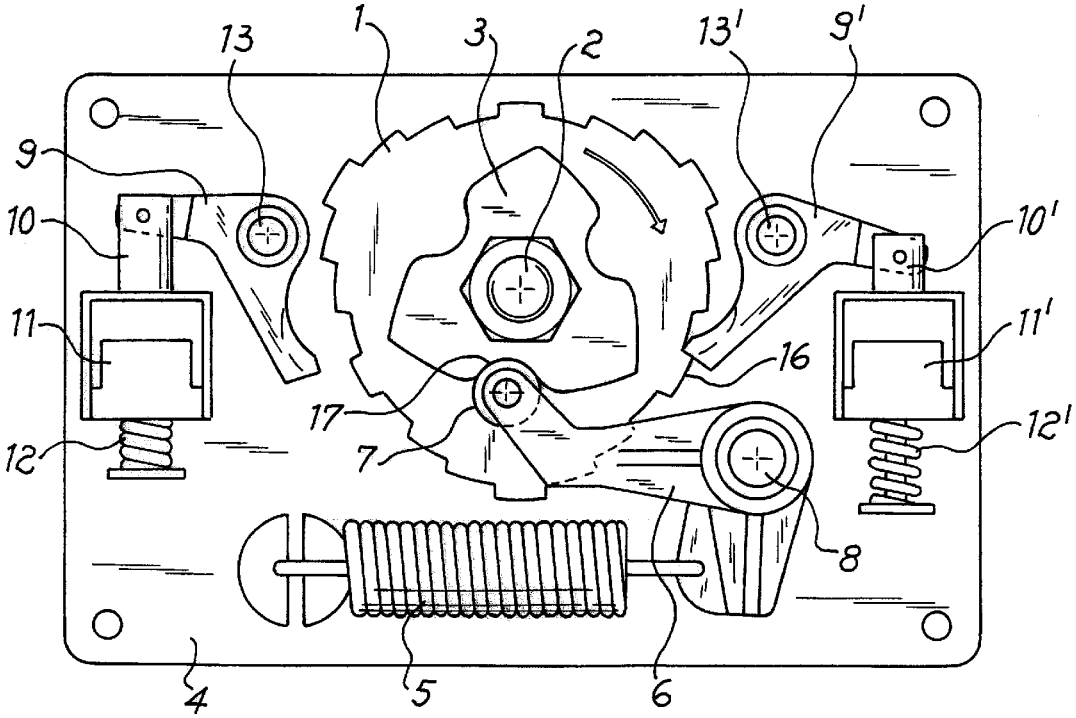

FIG. 2 shows the unlocking of the device upon a consent given by electronic circuits to one of the two electromagnets, in particular electromagnet 11 in the case illustrated. The activation of electromagnet 11 causes rod 10 to shift upwards, against the bias of spring 12 which is compressed, and consequently rotates lever 9 clockwise about pin 13. Since the other lever 9' does not move, wheel 1 can only rotate clockwise, as indicated by the arrow.

Figure 3:
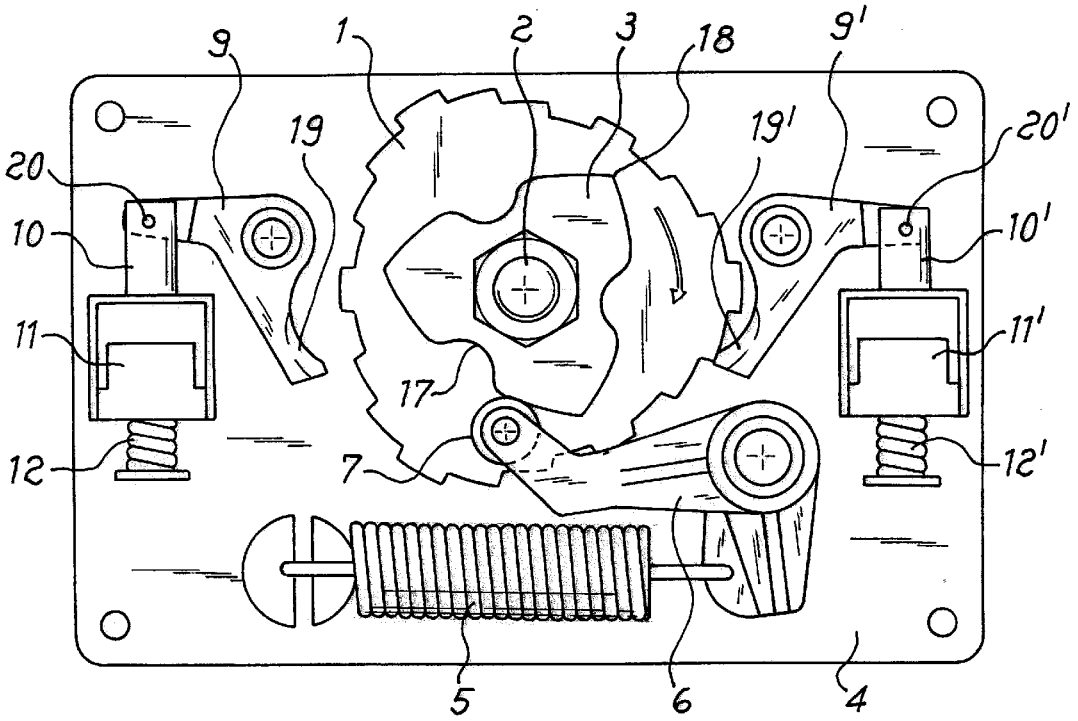
FIG. 3 is a view similar to the preceding one with the device at the beginning of the rotation.
Figure 4:
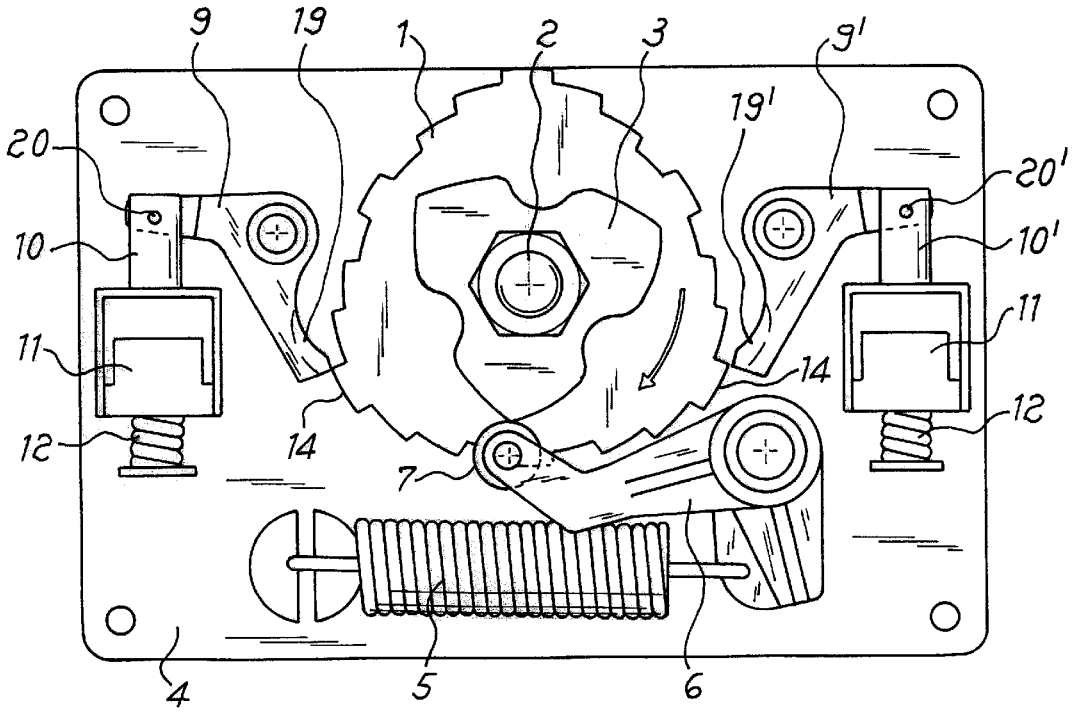
FIG. 4 is a view similar to the preceding one with the device at the middle of the rotation.

At this moment, the tripod can be rotated clockwise under the action of a person pushing on the horizontal arm of the tripod so as to overcome the strength of spring 5 and thus move away follower 6 from the center of cam 3 (see FIG. 3). In this way, roller 7 comes out of depression 17 and rises towards the following apex 18. At the same time, steps of increasing height are sliding beneath lever 9', whereby lever 9' is rotated counter-clockwise thus shifting rod 10' upwards against the bias of spring 12'. This spring 12' is only intended to keep lever 9' in contact with wheel 1, therefore it is not very strong.

When the roller 7 of follower 6 reaches apex 18 after 60° of rotation (FIG. 4), lever 9' has almost gone beyond a vertex tooth 14 while lever 9 is beginning to go beyond the preceding vertex tooth 14. In case the push on the tripod stops before apex 18 is reached, the traction of spring 5 pulls back roller 7 to the position of FIG. 2 thus rotating wheel 1 counter-clockwise. This is possible because lever 9' has not yet gone beyond the vertex tooth 14 and therefore finds steps of decreasing height. The function of automatic return to the starting position without play is thus achieved.

It should be noted that in order to make silent the sliding of levers 9, 9' on wheel 1 and to dampen the vibrations resulting therefrom, said levers include resilient members (19, 19'; 20, 20') respectively located at the free end and at the bore of connection to the control rod (10, 10').

Figure 5:
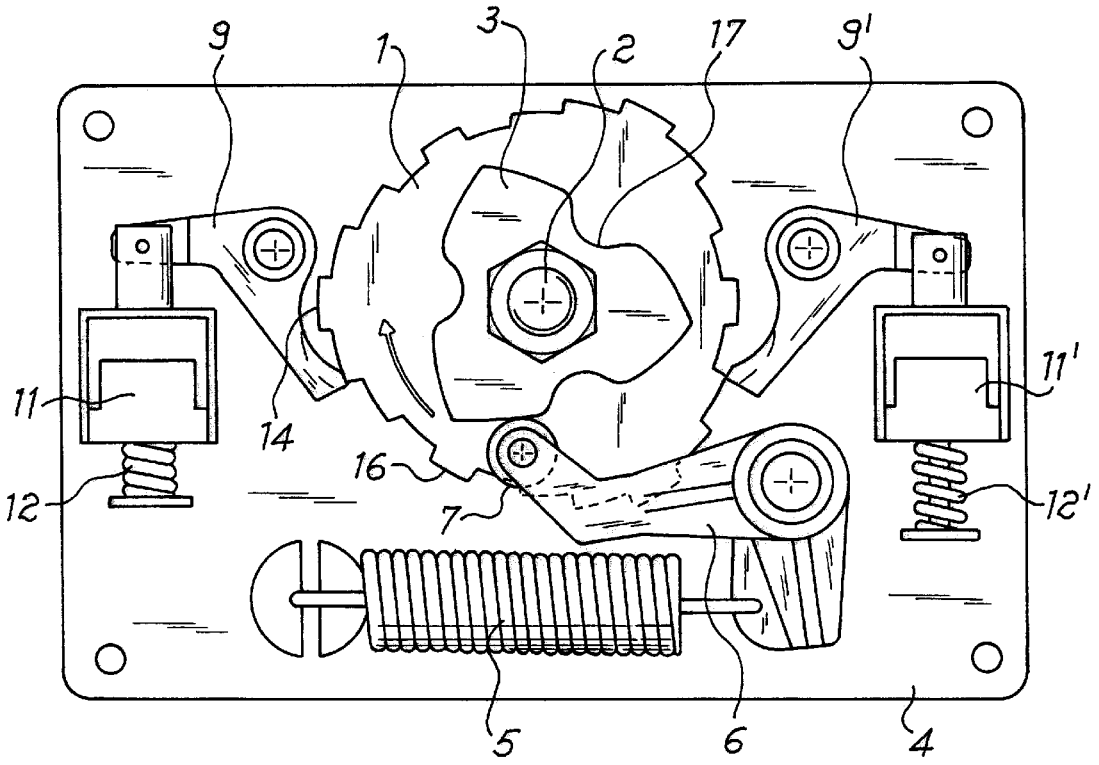
FIG. 5 is a view similar to the preceding one with the device at the end of the rotation.

Once apex 18 has been surpassed, and thus a rotation greater than 60° has been detected by a sensor (not shown), electromagnet 11 is deactivated and spring 12 returns lever 9 in contact with wheel 1 (FIG. 5). From this situation, spring 5 of the positioning mechanism completes the 120° rotation even in the absence of any further push on the tripod, until the locked position of FIG. 1 is reached again. This is possible because lever 9, having gone beyond the vertex tooth 14, finds only steps of decreasing height upto the following intermediate tooth 16.

Furthermore, also the anti-return function is achieved in this situation in order to prevent the walking-through of more than one person upon a single unlocking command. In fact, the reverse counter-clockwise rotation is prevented by lever 9' which, having gone beyond the vertex tooth 14, would find steps of increasing height thus engaging the flank of the first step.

Once the device has completed the 120° rotation and is back in the situation of FIG. 1, the operating cycle can start again in either direction indifferently. In fact, lever 9' acts as a ratchet for the counter-clockwise rotation while the concave surface facing wheel 1 allows the free clockwise rotation thereof, and the opposite is true for lever 9'. Therefore, if electromagnet 11' is activated so as to allow the counter-clockwise rotation, the above description of the device operation would still be applicable thanks to the perfect symmetry of the device.

It should be noted that the operating sequence described above is based on the assumption that the turnstile is always locked in both directions and the walking-through is allowed only upon a consent which controls the unlocking. However, the symmetry of the locking mechanisms allows to obtain four different operating sequences merely by inverting electromagnets 11, 11' and consequently the position of springs 12, 12' on the control rods 10, 10'.

In fact, if spring 12 is arranged on rod 10 so as to keep lever 9 away from wheel 1 until electromagnet 11 is activated to bring it in contact with wheel 1, the tripod is always free to rotate clockwise and locked in the counter-clockwise direction. The contrary is obtained by applying the above-described inversion to the other locking mechanism (9', 10', 11', 12'). Therefore it is possible to obtain a two-way turnstile which is always locked in both directions, or in one only of the directions, or even always free in both directions.

An advantage of the inverted arrangement is that it leaves the turnstile free to rotate in case of blackout, which can be considered a safety factor for certain applications. A further advantage of this arrangement is the lower wear of the device members. In fact, the device can be arranged so that the locking mechanisms intervene, by activating the electromagnets, only upon detection of a rotation not authorized by a prior consent. In this case the unauthorized rotation will be greater or smaller according to the time of reaction of the electromagnets and therefore to the step (15*a*, 15*b*, 15*c*) which will be engaged by one of the levers (9, 9'). However, thanks to the positioning system (3, 5, 6, 7), after the rotation has been stopped the tripod will return to the starting position without any residual play.

An example of a sensor for detecting the rotation as mentioned above is a Hall effect sensor integrated in a bearing, e.g. the SNR Sensor Line bearings sold by SNR Roulements (France). This type of bearing includes a Hall effect sensor integral with the fixed outer ring of the bearing and a multipolar magnetic ring integral with the inner rotating ring of the bearing, whereby the rotation can be precisely detected as to presence, amount, speed and acceleration. A standard bearing of shaft 2 can be easily replaced by such a sensorized bearing, thus achieving an inexpensive and precise monitoring of the rotation.

It is clear that the above-described and illustrated embodiment of the device according to the invention is just an example susceptible of various modifications. In particular, a change may be made in the number of decreasing steps (15*a*, 15*b*, 15*c*) which provide the anti-return function and the prevention of the unauthorized walking-through. Also, the means for actuating the locking levers 9, 9' may be different, e.g. hydraulic or pneumatic actuators. Similarly, the structural members such as springs 5, 12', 12', levers 9, 9', follower 6, and the like may be replaced by mechanically equivalent members.

What is claimed is:

1. A device for driving a revolving tripod of a two-way turnstile, characterized in that said device includes a wheel (1), having a periphery, keyed onto a shaft (2) together with a cam (3) and said tripod, a positioning mechanism engaging said cam (3) and suitable to cause a rotation thereof upto one of three stop positions 120° apart, and two specular mechanisms for locking said wheel (1) symmetrically arranged with respect thereto and each one including a locking member suitable to engage the periphery of the wheel (1) and an actuator suitable to take said locking member towards and away from said periphery, the wheel (1) being substantially shaped as an equilateral triangle with convex sides having a peripheral profile including a series of teeth and steps with straight flanks and different heights, among which a tooth (14) having the greatest height is found every 120° at the three vertices of the triangle and is followed in both directions of rotation by a plurality of steps (15*a*, 15*b*, 15*c*) of decreasing height, and three intermediate teeth (16) are found at 60° apart from said vertex teeth (14), the ends of the two locking members being positioned at two intermediate teeth (16) when the cam (3) is in one of its stop positions.

2. A device according to claim 1, characterized in that the positioning mechanism includes a spring (5) and a substantially L-shaped follower (6) rotating around a pin (8) and provided with a roller (7) at the end of the arm which engages the cam (3), said spring (5) being secured at the other arm of said follower (6) so as to keep it in contact with the cam (3), said cam (3) being shaped as an equilateral triangle with convex sides having a marked central depression (17) provided with a bending radius substantially equal to the radius of said roller (7), thus resulting in a trilobate shape with lobes ending in an apex (18).

3. A device according to claim 1, characterized in that the locking member of each locking mechanism is a substantially L-shaped lever (9, 9') rotating around a pin (13, 13'), and the actuator driving said lever (9, 9') includes a rod (10, 10') connected to the lever (9, 9') at the end thereof opposite to the end engaging the wheel (1), said rod (10, 10') being driven by an electromagnet (11, 11') which overcomes the bias of a spring (12, 12') arranged on the rod (10, 10').

4. A device according to claim 3, characterized in that the spring (12, 12') is arranged on the rod (10, 10') so as to keep the lever (9, 9') in contact with the wheel (1) when the electromagnet (11, 11') is not activated.

5. A device according to claim 3, characterized in that the spring (12, 12') is arranged on the rod (10, 10') so as to keep the lever (9, 9') away from with the wheel (1) when the electromagnet (11, 11') is not activated.

6. A device according to claim 3, characterized in that the lever (9, 9') includes two resilient members (19, 19'; 20, 20') respectively located at a free end engaging the wheel (1) and at a bore where the rod (10, 10') is connected to said lever (9, 9').

7. A device according to claim 1, further including sensor means for detecting the rotation of the shaft (2).

8. A device according to claim 7, characterized in that the sensor means include a fixed Hall effect sensor and a rotating multipolar magnetic ring integrated in a bearing supporting the shaft (2).

* * * * *